US008061935B2

(12) United States Patent
Weaver et al.

(10) Patent No.: US 8,061,935 B2
(45) Date of Patent: Nov. 22, 2011

(54) ROCK BOLT AND AN ANCHORING DEVICE

(75) Inventors: Steven Weaver, New South Wales (AU); Darren Webb, New South Wales (AU); John Horsch, New South Wales (AU); Matthew Kenny, New South Wales (AU)

(73) Assignee: Sandvik Intellectual Property AB, Sandviken (SE)

( * ) Notice: Subject to any disclaimer, the term of this patent is extended or adjusted under 35 U.S.C. 154(b) by 250 days.

(21) Appl. No.: 12/312,336

(22) PCT Filed: Oct. 23, 2007

(86) PCT No.: PCT/SE2007/000928

§ 371 (c)(1), (2), (4) Date: Aug. 6, 2009

(87) PCT Pub. No.: WO2008/060211

PCT Pub. Date: May 22, 2008

(65) Prior Publication Data

US 2009/0297279 A1 Dec. 3, 2009

(30) Foreign Application Priority Data

Nov. 15, 2006 (AU) ..... 2006236010
Nov. 15, 2006 (AU) ..... 2006236012

(51) Int. Cl.
*E21D 21/00* (2006.01)

(52) U.S. Cl. ..... 405/259.4; 405/259.1; 411/29; 411/64; 411/67

(58) Field of Classification Search ..... 405/259.1, 405/259.3, 259.4; 411/29, 30, 64, 65, 66, 411/67

See application file for complete search history.

(56) References Cited

U.S. PATENT DOCUMENTS 3,250,170 A * 5/1966 Siegel ..... 405/259.1
3,316,797 A * 5/1967 Williams ..... 405/259.3
4,437,795 A 3/1984 White
4,861,198 A * 8/1989 Stankus ..... 405/259.3
5,018,908 A * 5/1991 Laphon ..... 405/259.3

(Continued)

FOREIGN PATENT DOCUMENTS

AU 2006202778 1/2008

(Continued)

OTHER PUBLICATIONS

Russian Office Action (with English translation) issued in Russain application No. 2009122489/03 (031069) dated Jul. 29, 2011.

(Continued)

*Primary Examiner* — Frederick L Lagman

(74) *Attorney, Agent, or Firm* — Drinker Biddle & Reath LLP

(57) ABSTRACT

The present invention relates to a rock bolt comprising first and second ends, a shaft extending between the ends, and an anchoring device extending along a first part of the shaft adjacent the first end. The anchoring device comprises a mandrel, and at least one expansion element overlaying the mandrel. The expansion element is displaced radially outwardly on a predetermined relative movement between the mandrel and the expansion element. The expansion element is joined to a connector to form an anchor assembly. The anchor assembly is keyed to the mandrel. The anchor assembly comprises relative rotation actuator means active during rotation of the anchoring device. The invention further relates to an anchoring device per se.

18 Claims, 4 Drawing Sheets

U.S. PATENT DOCUMENTS

| | | | | |
|---|---|---|---|---|
| 5,087,160 | A * | 2/1992 | Pezzutto | 405/259.1 |
| 5,275,512 | A | 1/1994 | Wright | |
| 5,344,257 | A * | 9/1994 | Wright et al. | 405/259.4 |
| 7,896,580 | B2 * | 3/2011 | Weaver et al. | 405/259.4 |
| 2009/0220309 | A1 * | 9/2009 | Weaver et al. | 405/259.3 |
| 2010/0098500 | A1 * | 4/2010 | Weaver et al. | 405/259.1 |
| 2011/0103896 | A1 * | 5/2011 | Horsch et al. | 405/259.1 |

FOREIGN PATENT DOCUMENTS

| | | |
|---|---|---|
| SU | 549577 | 4/1977 |
| SU | 651136 | 3/1979 |
| SU | 826004 | 4/1981 |
| SU | 1182176 | 9/1985 |
| WO | 2005/047649 | 5/2005 |
| WO | 2007/053893 | 5/2007 |
| WO | WO 2009029013 A1 * | 3/2009 |

OTHER PUBLICATIONS

Russian Office Action (with English translation) issued in Russain application No. 2009122484/03 (031064) dated Sep. 20, 2011.

* cited by examiner

ROCK BOLT AND AN ANCHORING DEVICE

RELATED APPLICATION DATA

This application is a §371 National Stage Application of PCT International Application No. PCT/SE20073/000928 filed Oct. 23, 2007, and claims priority under 35 U.S.C. §119 and/or §365 to Australian Application No. 2006236010, filed Nov. 15, 2006, and to Australian Application No. 2006236012, filed Nov. 15, 2006, the entire contents of which are incorporated herein by reference.

TECHNICAL FIELD

The present invention relates to rock bolts suitable for use in the mining and tunnelling industry to provide roof and wall support. The invention is suitable for use in hard rock applications as well as in softer strata, such as that often found in coal mines, and it is to be appreciated that the term "rock" as used in the specification is to be given a broad meaning to cover both these applications. The invention further relates to an anchoring device per se.

BACKGROUND

Roof and wall support is vital in mining and tunnelling operations. Mine and tunnel walls and roofs consist of rock strata, which must be reinforced to prevent the possibility of collapse. Rock bolts are widely used for consolidating the rock strata.

In conventional strata support systems, a hole is drilled into the rock by a drill rod, which is then removed and a rock bolt is then installed in the drilled hole and secured in place typically using a resin or cement based grout.

To improve this process, self drilling rock bolts have been proposed whereby the bolt is also used as the drill rod. As such, with a self drilling rock bolt, the hole can be drilled and the bolt installed in a single pass.

Whilst self drilling rock bolts provide the opportunity to substantially improve installation times of rock bolts, they have not been widely used.

Rock bolts are furthermore at times not anchoring in the predrilled hole as well as can be expected.

SUMMARY OF THE INVENTION

In accordance with a first aspect of the present invention, there is provided a rock bolt comprising first and second ends is provided having a shaft extending between the ends, an anchoring device extending along a first part of the shaft adjacent the first end, the anchoring device comprising a mandrel, and at least one expansion element overlaying the mandrel, wherein the at least one expansion element is displaced radially outwardly on a predetermined relative movement between the mandrel and the at least one expansion element, wherein the at least one expansion element is joined to a connector to form an anchor assembly, said anchor assembly being keyed to the mandrel, and said anchor assembly comprising relative rotation actuator means active during rotation of the anchoring device. In a particular form, the connector comprises the relative rotation actuator means. In a particular form, the connector includes a body section and at least one connecting leg, said leg carrying said relative rotation actuator means.

In a particular form, the relative rotation actuator means is a tag that is provided adjacent to an end of the leg and is integrated with the connector, said tag being adapted to be passive during rotation in a first direction and active in a second direction during anchoring of the anchoring device.

In a particular form, the connector comprises two legs, each leg having at least one tag.

In a particular form, each tag projects from the leg in the second direction.

In a particular form, the rock bolt is a self drilling rock bolt, wherein the first end has a drill bit to penetrate rock during drilling in the first direction.

In one form, the mandrel is mounted to and cooperating with an external thread on the shaft and at least one expansion element overlaying the mandrel, wherein the at least one expansion element is displaced radially outwardly on a predetermined relative movement between the mandrel and the at least one expansion element, wherein the connector is arranged to be loosely held between a drill bit and an end of the shaft end, wherein said drill bit or said mandrel and said connector comprises a relative rotation stop.

In one form, the relative rotation stop is provided to stop the anchor assembly from rotating about the drill shank axis thereby preventing the mandrel from moving axially in one direction along the bolt shaft during drilling in said first direction.

In a particular form, the relative rotation stop means comprise a recessed surface on a shoulder surface of the drill bit or mandrel and a projection provided on the connector, said recessed surface housing said projection at least during drilling.

In accordance with another aspect of the invention there is provide an anchoring device for a for a rock bolt is provided for retaining the bolt when located in a drilled hole comprising a mandrel, and at least one expansion element overlaying the mandrel, wherein the at least one expansion element is displaced radially outwardly on a predetermined relative movement between the mandrel and the at least one expansion element, wherein the at least one expansion element is joined to a connector to form an anchor assembly, said anchor assembly being keyed to the mandrel, and said anchor assembly comprising relative rotation actuator means. In a particular form, the connector comprises the relative rotation actuator means.

In one form, the connector includes a body section and at least one connecting leg, said leg carrying said relative rotation actuator means.

In a particular form, the relative rotation actuator means is a tag that is provided adjacent to an end of the leg and is integrated with the connector, said tag being adapted to be passive during rotation in the first direction and active in the second direction during anchoring of the anchoring device. In a particular form, the connector comprises two legs, each having at least one tag. In a particular form, each tag projects from the leg in the second direction. In a particular form, the mandrel has an internal thread and at least one expansion element overlaying the mandrel, wherein the at least one expansion element is displaced radially outwardly on a predetermined relative movement between the mandrel and the at least one expansion element, wherein said connector comprise relative rotation stop means. In a particular form, the relative rotation stop means comprise a projection provided on the connector. In a particular form, the anchoring device is adapted to be connected to a self drilling rock bolt.

BRIEF DESCRIPTION OF THE DRAWINGS

It is convenient to hereinafter describe embodiments of the present invention with reference to the accompanying drawings. The particularity of the drawings and the related description is to be understood as not superseding in generality of the preceding broad description of the invention.

In the drawings.

DETAILED DESCRIPTION OF THE DRAWINGS

Figure 1:
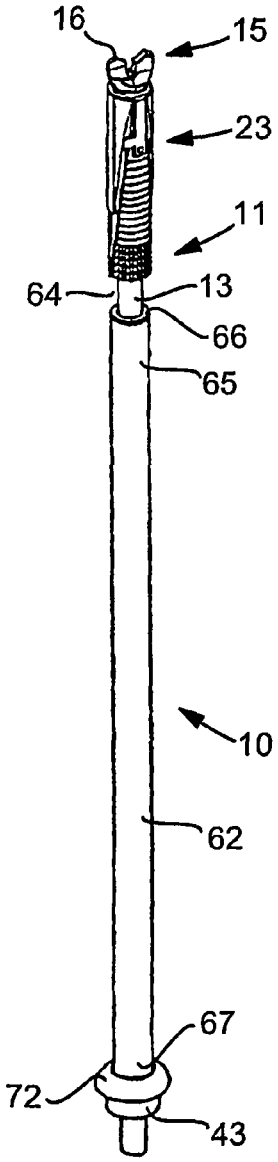
FIG. 1 is a schematic perspective view of a self drilling rock bolt.
Figure 6B:
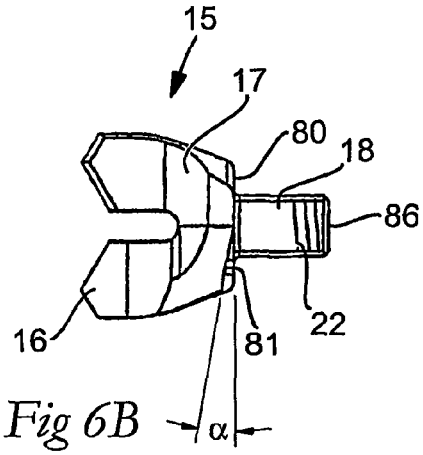
FIG. 6B is a side view of a drill bit of the self drilling rock bolt of FIG. 1.
Figure 6A:
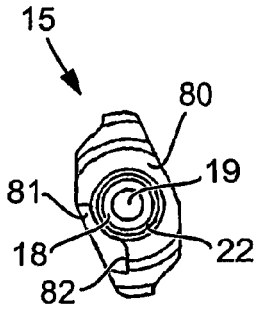
FIG. 6A is a bottom view of a drill bit of the self drilling rock bolt of FIG. 1.

FIG. 1 illustrates a self drilling rock bolt 10 which incorporates a first (drilling) end 11 and a second (nut) end 12 and a shaft 13 which extends between the opposite ends 11, 12. The shaft 13, which is typically made from steel, is solid along a major (second) part of its length and incorporates an inner passage 14 (see FIG. 4) along a distal (first) part of bolt adjacent the drilling end. The inner passage communicate with the exterior of the shaft at two places; though a lateral port 60, and through an end port 61.

In use, the self drilling rock bolt 10 is connected to a drilling and bolting apparatus (not shown) and acts as a drill rod to drill a hole 100 (see FIG. 4) into rock strata 500. Thereafter, the rock bolt 10 is secured in place as will be explained in more detail below to provide support for the rock strata 500.

The drilling end 11 incorporates a drill bit 15 incorporating a drill tip 16 at an end thereof and an anchoring device 23 which in use is arranged to retain the bolt in a drilled hole. The anchoring device 23 extends along the first part of the bolt and is used to retain the bolt 10 in the drilled hole so as to temporarily secure the rock bolt in place prior to the introduction of grout into the hole 100 to permanently fix the bolt in place and/or to tension the bolt so as to place the rock strata 500 in compression.

The details of the drilling end 11 are best seen in FIGS. 2A to 6B.

During a drilling operation, the drilling apparatus typically induces right hand rotation to the drill shaft. To ensure that the drill bit 15 does not separate from the shaft during the drilling operation, the threaded coupling between the drill bit 15 and the shaft 13 is a right handed thread so as to tend to cause the threaded coupling between the drill bit and shaft to tighten during a drilling operation.

Figure 4:
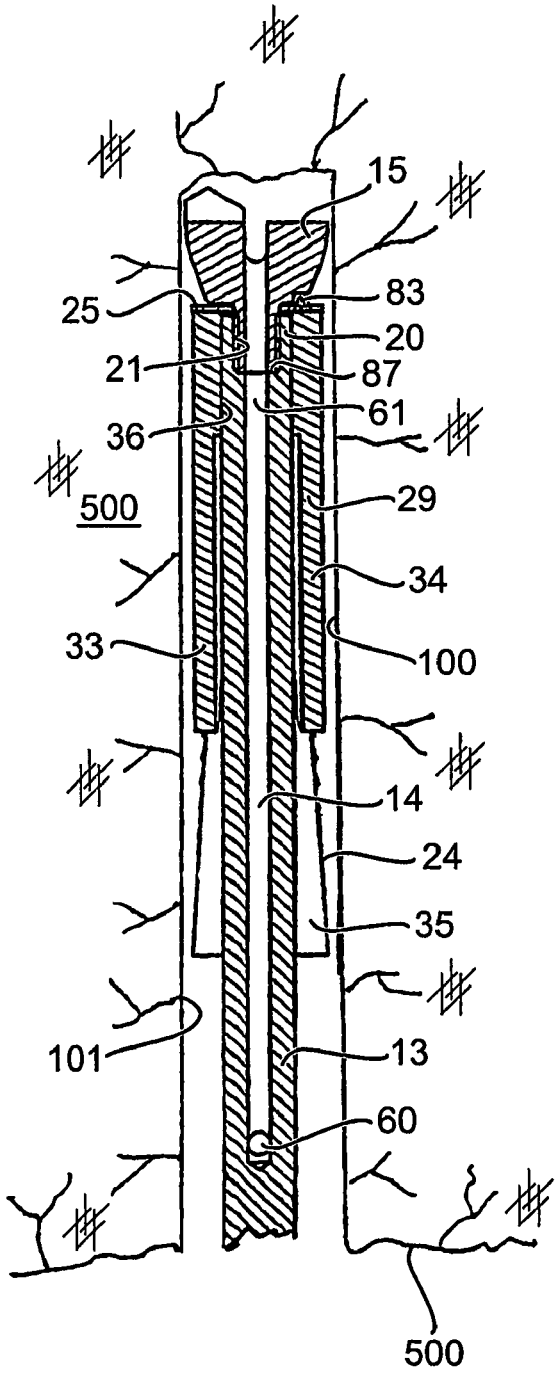
FIG. 4 is a sectional view of the first end of the self drilling rock bolt of FIG. 1 when located in rock strata.
Figure 7:
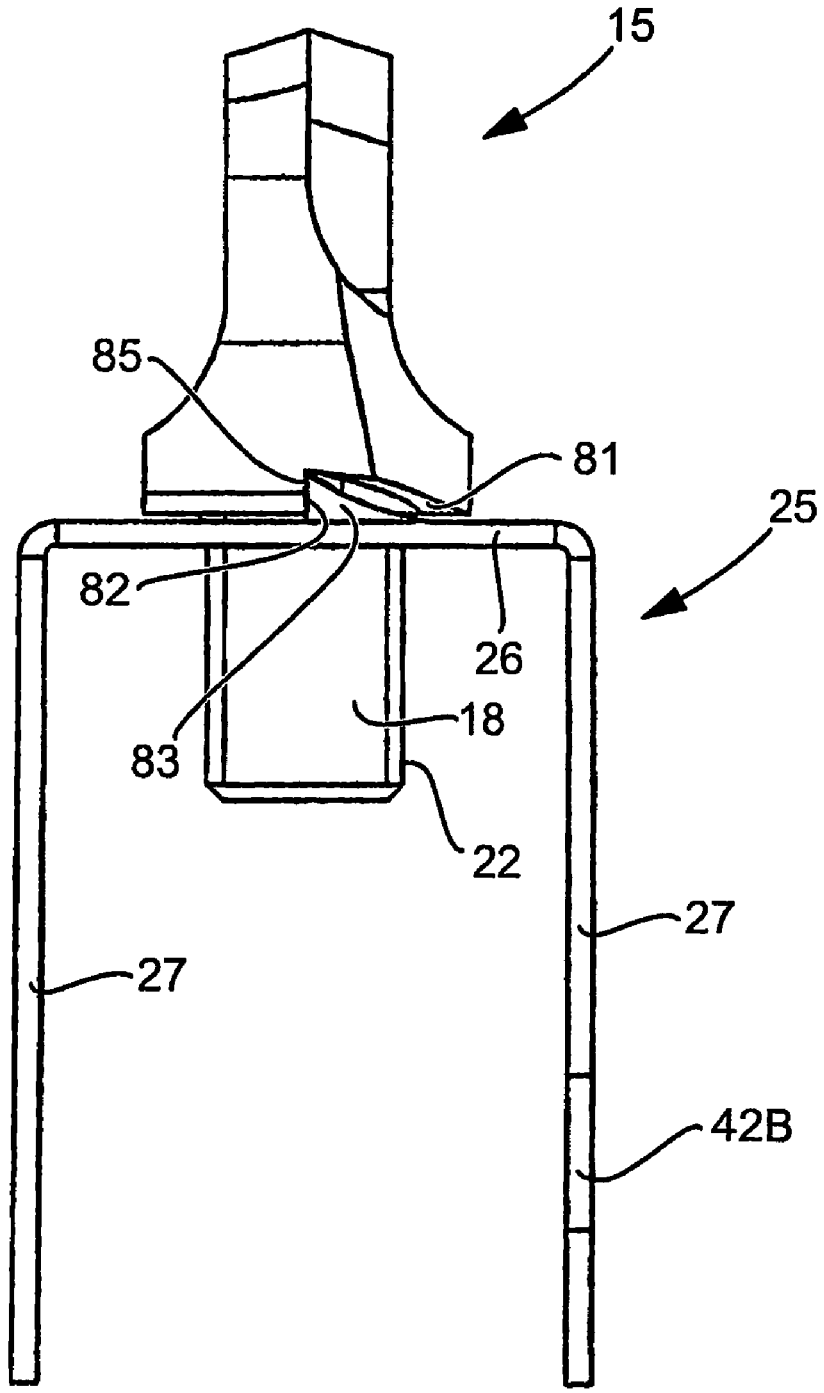
FIG. 7 is a side view of the drill bit of FIGS. 6A and 6B in engagement with the connector of FIGS. 5A and 5B.

The drill bit 15 includes a bit body 17 which includes the drill tip 16 at its outer end and a drill bit shank 18 which incorporates a fastening means such as an external thread 22 on its outer surface. A passage 19 extends from the distal tip of the shank 18 through to the distal end of the bit body 17. This passage 19 is arranged to be in fluid communication with end port 61 of the inner passage 14 of the shaft when the drill bit 15 is secured to the shaft end 20 (as best seen in FIG. 4). The shaft end 20 includes an inner thread 21 (see FIG. 4) which is complementary to the external thread 22 on the drill bit shank 18. As such, the drill bit 15 can be simply screwed on to shaft end 20 of the shaft 13.

The drill bit 15 is provided with a shoulder surface 80 in connection with the drill bit shank 18. The shoulder surface 80 extends substantially perpendicularly to the drill bit shank. The shoulder surface faces towards the shaft 13 when the drill bit has been mounted. The shoulder surface comprises at least one recessed surface 81 that forms at least one upstanding wall 82. The recessed surface 81 is inclined at an acute angle $\alpha$ relative to the shoulder surface. The magnitude of the angle is greater than a pitch angle of the external thread formed on the drill shank. The magnitude of the angle $\alpha$ is at least 20% greater than the pitch angle of an external thread 38 formed on the bolt shaft 13. Stated in another way, the recessed surface inclines similar to a left handed thread as opposed to the right handed thread 22 in FIG. 6B. The upstanding wall 82 is to form part of a relative rotation stop discussed more in detail below.

The anchoring device 23 is disposed below the drill bit 15 and includes a pair of expansion elements 24 which are designed to be caused to move outwardly from a retracted position as illustrated in the drawings to an expanded condition (not shown) wherein the expansion elements 24 engage the wall 101 of the drilled hole 100.

The expansion elements 24 are interconnected by a connector or a bail strap 25. This connector is typically made from steel and includes a substantially circular body section 26 and connecting legs 27. The connecting legs 27 are riveted (or otherwise fixed) to a proximal end 28 of the expansion elements 24. The expansion elements are joined to the connector to form an anchor assembly. By making the connector 25 from steel, it can flex thereby providing a live hinge that allows pivoting of the expansion elements so as to enable them to easily move between their retracted and their extended position.

Figure 5B:
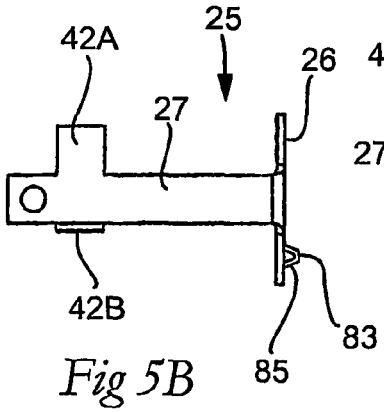
FIG. 5B is a side view of a connector of the self drilling rock bolt of FIG. 1 partly in a collapsed condition and partly in an expanded condition.

The body section 26 is preferably substantially circular and comprises a central hole 84 to receive the drill bit shank 18. The body section 26 is provided with at least one projection or upstanding tongue 83 at the surface facing towards the drill bit 15. The tongue 83 is preferably punched out of the body section at a mid-area location, i.e. at a location in between the hole 84 and a periphery of the body section. The tongue 83 has a general V-shape as best seen in FIG. 5B but may have any suitable shape such as a U-shape or semicircular. The tongue has a maximum height that is less than the largest depth of the recessed surface 81. The tongue comprises a leading edge 85, i.e. leading if the connector is rotated in the left hand direction. The leading edge 85 is substantially perpendicular to a plane of the body section 26. The tongue is to be received by the recessed surface 81 and can abut against the upstanding wall 82 during drilling. Thus, the tongue is to form part of the relative rotation stop discussed more in detail below.

Figure 5A:
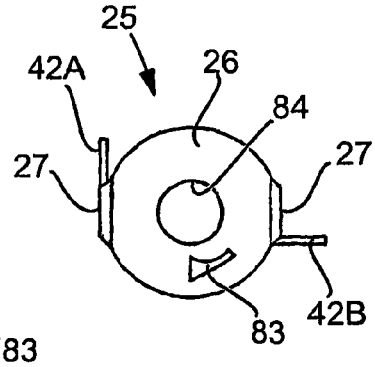
FIG. 5A is a top view of a connector of the self drilling rock bolt of FIG. 1 partly in a collapsed condition and partly in an expanded condition.
Figure 2A:
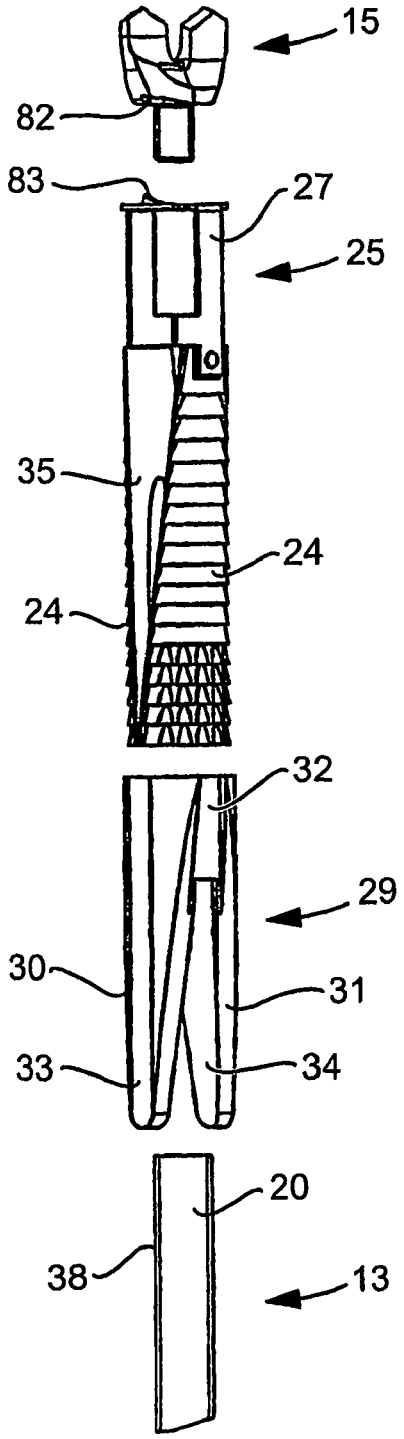
FIG. 2A is an exploded view of a first end of the self drilling rock bolt of FIG. 1.
Figure 2B:
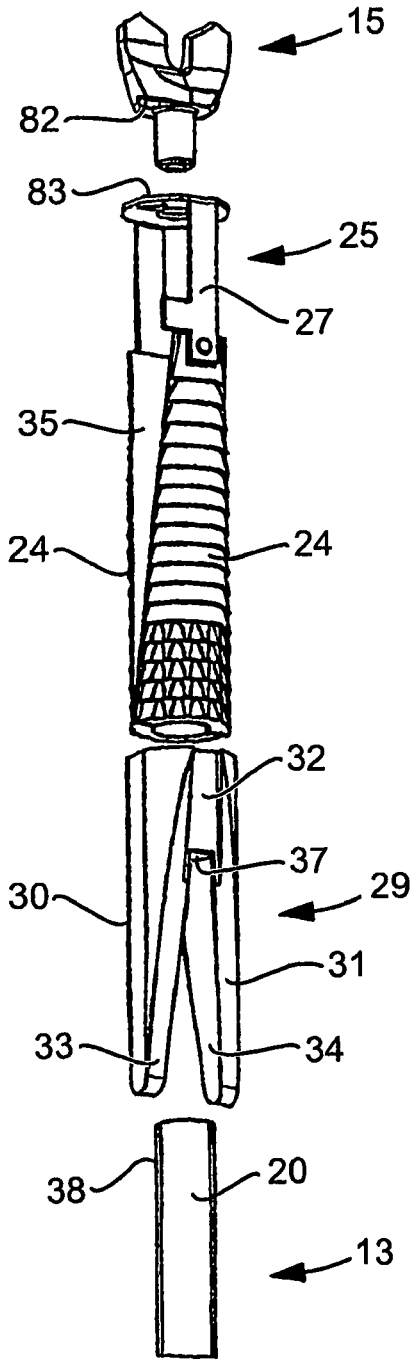
FIG. 2B is another exploded view of the first end of the self drilling rock bolt of FIG. 1.

Since the anchoring device may get stuck at the shaft end 20, each leg 27 carries a relative rotation actuator means or leading tag 42A, 42B, i.e. 'leading' if the connector 25 is rotated in the left hand direction or the second direction of rotation. Thus, each tag 42A, 42B projects from the leg in the second direction of rotation. The tag 42A, 42B is provided adjacent to an end of the leg distal from the body section 26 and is integrated with the connector. In FIGS. 5A and 5B the tag 42A is shown in a retracted position while the tag 42B is shown in an expanded position, for illustrative reasons. Thus, the tag is adapted to be passive during drilling (right hand rotation) but active or bent outwardly during anchoring (left hand rotation). The geometries of the tags are optional, for example the tag can be concertina shaped.

The anchoring device 23 further includes a mandrel 29 which includes opposite inclined surfaces 30 and 31. In the illustrated form, the mandrel 29 includes a head portion 32 and two depending legs 33 and 34 with opposite faces of the head portion 32 and opposite edge surfaces of the legs 33 and 34 forming respective ones of the inclined surfaces 30 and 31. The head portion 32 may have two opposed grooves to house parts of the legs of the connector.

The mandrel is arranged so that the inclined surfaces 30 and 31 are generally flat and designed to abut with inner surfaces 35 of the expansion elements 24 in a manner such that relative movement of the mandrel towards the nut end 12 of the shaft causes the expansion elements to move from their retracted position to their extended position.

To enable this relative movement, the mandrel is coupled to the bolt shaft which in the illustrated arrangement is through a threaded coupling with an internal thread 36 formed in an inner bore 37 in the head portion 32 of the mandrel 29 and an external thread 38 formed on the bolt shaft 13.

The threaded coupling between the mandrel 29 and the bolt shaft 13 is a left handed thread so that when the rock bolt is undergoing a drilling operation (under right hand rotation of the shaft), any relative motion between the mandrel and the shaft would cause the mandrel to move towards the drill end thereby ensuring that the expansion elements are not moved to their expanded condition. At the same time the self drilling rock bolt avoids the problem of tightening the mandrel so hard against the connector and the drill bit that the mandrel cannot be loosened. In an alternative form the mandrel could be provided with a projection or recess that cooperates directly with a recess or projection on the drill bit to provide an alternative first rotation stop.

The anchoring device 23 may further comprise an annular band, not shown, which can be disposed around a distal end of the expansion elements 24. The annular band is typically made from a polymeric or rubber material and is provided to hold the expansion elements 24 together only during transport and start of drilling.

Figure 3:
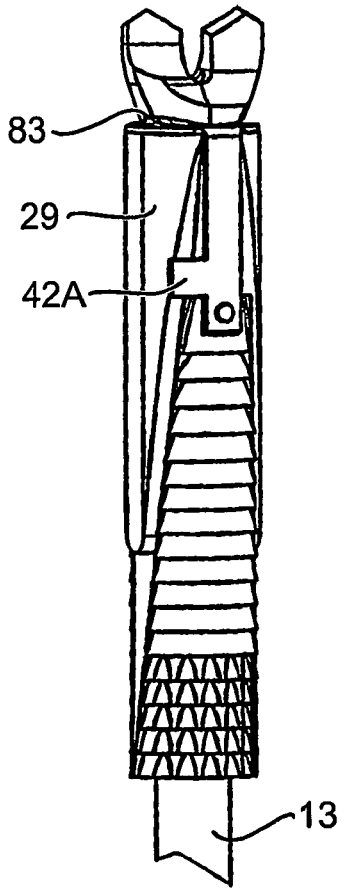
FIG. 3 is a side view of the first end of the self drilling rock bolt of FIG. 1.

The tags 42A, 42B of the connector are arranged to adopt two conditions. In the first condition as illustrated in FIG. 3, the tags 42A, 42B are folded towards the mandrel 29. This condition occurs when the tags undergo right hand rotation as would be the case during the drilling operation. In the second condition as best illustrated to the right in FIG. 5A, the tags bend outwardly from the periphery of the connector 25. This occurs during the opposite rotation of the bolt and is induced by tags passing over the wall surface 101 of the drilled hole under this rotation. When in this second (or expanded) condition, there is a greater tendency for the tags to engage the wall surface of the drilled hole. Once they do grip, the anchoring device begins to slip relative to the shaft thereby inducing some relative movement. This movement, in turn causes the mandrel to start winding down the shaft thereby causing the expansion elements to be displaced outwardly.

Thus, the connector 25 can perform several functions. The first function is to hold the expansion elements a set distance axially from the end of the shaft. The second function is to rotationally join the mandrel and the expansion elements together. The third function is to provide a hole so that the drill bit can be threaded into the shaft. The fourth function is to form part of the rotation stop means that stops the mandrel from being screwed tightly against the drill bit. The fifth function is to provide tags that grip the bore wall during anchoring, thus allowing the anchoring device to rotate relative to the shaft.

As illustrated in FIG. 1, the rock bolt 10 includes a sleeve 62 along a major part of the shaft 13. The sleeve 62 extends from adjacent the anchoring device 23 through to and adjacent the nut end 12. The purpose of the sleeve is to provide at least part of a circulation path to allow fluid to be passed from the nut end 12 to the drilling end 11. This circulation path is provided by a passage formed between the bolt shaft 13 and the sleeve 62 as well as the inner passage 14. The inner passage 14 communicates with a passage formed between the shaft 13 and the sleeve 62 through the lateral port 60.

The circulation path also includes an outer passage 64 formed between the sleeve 62 and the wall 101 of the drilled hole 100. This outer passage is formed by having the drill tip 16 extend radially a distance greater than the radius of the sleeve 62.

The sleeve 62 is sealed at its distal end 65 by a collar 66. This collar 66 can incorporate an internal thread to be threaded onto the external thread 38 machined on the upper part of the shaft 13.

The proximal end 67 of the sleeve 62 is also sealed by inter engaging with a drive coupler 43 as described in detail in applicant's Australian patent application No. 200620778, which is hereby incorporated into the present specification.

A bearer plate and ball washer 72 may be disposed on the shaft 13 and captured by the drive nut 43. The bearer plate is arranged to bear against the outer face of the rock strata 500.

Before operation, the anchoring device 23 is threaded onto the shaft 13 suitably until the shaft end 20 abuts against the lower side of the body section 26 of the connector 25. Then the drill bit 15 is threaded into the inner thread 21 of the shaft end until a drill bit shank end 86 engages a bottom 87 of the inner thread 21.

In operation, the bolt 10 is secured to a drilling apparatus, via the drive nut 43, which rotates the rock bolt in the first direction. Drilling fluid is pumped around the circulation passage formed by passage between the shaft and the sleeve 62, inner passage 60, and outer passage 64 to flush the rock cutting surface of the rock bolt. The fluid is either introduced or withdrawn from a port in the irrigated drive nut 43.

On completion of the drilling phase, the drilling apparatus then rotates the bolt in the opposite direction. The drive nut 43 rotates with the shaft 13 as relative movement is prevented by a torque pin. This causes the tags 42A, 42B to flare outwards causing the connector to grip the wall surface 101 causing the expansion elements 24 and mandrel 29 to start to slip relative to the bolt shaft. This relative movement induced between the anchoring device and the shaft causes the mandrel to wind down the thread of the shaft thereby causing the expansion elements to displace radially outwardly to engage the rock surface of the drilled hole.

When the expansion elements are engaged with the wall surface, the bolt is placed in tension by continuing to apply torque in the second direction to the drive nut 43. At a particular point, the expansion elements 24 are forced so hard against the rock wall surface that the mandrel cannot move down the shaft any further. This then effectively binds the bolt and inhibits it from rotating any further. This builds up the torque at the drive nut 43 until it reaches a point where it will shear a torque pin thereby letting the drive nut to move relative to the shaft. This relative movement then causes the nut to wind up the shaft.

Once the drive nut is able to move along the bolt shaft, it will then move into engagement the outer face of the rock strata 500 (either directly or through the bearer plate) which will then enable the bolt to be placed in tension as the effective length of the bolt between the drive nut and the anchoring device is shortened. Once the bolt is under sufficient tension, the drilling apparatus can then be removed and possibly for further support a final stage of setting the bolt in place by the introduction of the grout through a port in the drive nut 43 can take place.

It is to be understood that the anchoring device 25 as claimed can be used for a rock bolt that is not self drilling, i.e. that needs a predrilled hole before insertion of the bolt therein.

In the claims which follow and in the preceding description of the relative rotation actuator means where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Variations and/or modifications may be made to the parts previously described without departing from the spirit or ambit of the invention.

The invention claimed is:

1. A rock bolt comprising first and second ends, a shaft extending between the ends, and an anchoring device extending along a first part of the shaft adjacent the first end, the anchoring device comprising a mandrel, and at least one expansion element overlaying the mandrel, wherein the at least one expansion element is displaced radially outwardly on a predetermined relative movement between the mandrel and the at least one expansion element, wherein the at least one expansion element is joined to a connector to form an anchor assembly, said anchor assembly being keyed to the mandrel, and said anchor assembly comprising relative rotation actuator means active during rotation of the anchoring device;

wherein the connector includes a body section and at least one connecting leg, the relative rotation actuator means including one or more tags that extend from the at least one leg, the one or more tags being adapted to be passive during rotation in a first direction and active during rotation in a second direction;

wherein the one or more tags are arranged to not grip the wall surface of a drilled hole when the bolt is rotated in the first direction, and to grip the wall surface when the bolt is rotated in the second direction so as to enable anchoring of the anchoring device, thereby inducing the predetermined movement.

2. A rock bolt according to claim 1, wherein the relative rotation actuator means is disposed on the connector.

3. A rock bolt according to claim 1, wherein the connector includes a body section and at least one connecting leg, said leg carrying said relative rotation actuator means.

4. A rock bolt according to claim 1, wherein on engagement of the tag(s) with the wall surface of a drilled hole, the tag(s) are biased to fold against the anchoring device when rotated in the first direction and are biased to extend outwardly so as to grip the wall surface of the drilled hole when the bolt is rotated in the second direction.

5. A rock bolt according to claim 1, wherein the connector comprises two legs, each leg having at least one tag.

6. A rock bolt according to claim 1, wherein each tag projects from the leg in the second direction.

7. A rock bolt according to claim 1, wherein the rock bolt is a self drilling rock bolt, wherein said first end has a drill bit to penetrate rock during drilling in the first direction.

8. A rock bolt comprising first and second ends, a shaft extending between the ends, and an anchoring device extending along a first part of the shaft adjacent the first end, the anchoring device comprising a mandrel, and at least one expansion element overlaying the mandrel, wherein the at least one expansion element is displaced radially outwardly on a predetermined relative movement between the mandrel and the at least one expansion element, wherein the at least one expansion element is joined to a connector to form an anchor assembly, said anchor assembly being keyed to the mandrel, and said anchor assembly comprising relative rotation actuator means active during rotation of the anchoring device;

wherein the rock bolt is a self drilling rock bolt, wherein said first end has a drill bit to penetrate rock during drilling in the first direction; and wherein the mandrel is mounted to and cooperating with an external thread on the shaft and at least one expansion element overlaying the mandrel, wherein the at least one expansion element is displaced radially outwardly on a predetermined relative movement between the mandrel and the at least one expansion element, wherein the connector is arranged to be loosely held between a drill bit and an end of the shaft end, wherein said drill bit or said mandrel and said connector comprises a relative rotation stop.

9. A rock bolt according to claim 8, wherein said relative rotation stop is provided to stop the anchor assembly from rotating about the drill shank axis thereby preventing the mandrel from moving axially in one direction along the bolt shaft during drilling in said first direction.

10. A rock bolt according to claim 8, wherein the stop limits the anchoring device from rotating on the shaft so as to maintain a space between an end surface of the anchoring device and an end surface of the drill bit during drilling.

11. A rock bolt according to claim 8, wherein the stop comprises cooperating abutment surfaces, one said surface disposed on the drill bit and the other surface disposed on the anchoring device.

12. A rock bolt according to claim 8, wherein said stop comprise a recessed surface on a shoulder surface the drill bit and a projection provided on the connector or mandrel, said recessed surface housing said projection at least during drilling.

13. An anchoring device for a rock bolt for retaining the bolt when located in a drilled hole comprising:

a mandrel; and an anchor assembly keyed to the mandrel, the anchor assembly including a connector and at least one expansion element joined to the connector and overlaying the mandrel, the connector including a body section and at least one connecting leg carrying a relative rotation actuator means, the relative rotation actuator means including one or more tags that project from the at least one leg;

wherein the at least one expansion element is displaced radially outwardly on a predetermined relative movement between the mandrel and the at least one expansion element, and wherein the one or more tags are adapted to be passive during rotation in the first direction and active in a second direction during anchoring of the anchoring device;

wherein the one or more tags are arranged to not grip the wall surface of a drilled hole when the bolt is rotated in the first direction, and to grip the wall surface when the boll is rotated in the second direction so as to enable anchoring of the anchoring device, thereby inducing the predetermined movement.

14. An anchoring device according to claim 13, wherein the connector comprises two legs, each having at least one tag.

15. An anchoring device according to claim 13, wherein each tag projects from the leg in the second direction.

16. An anchoring device according to claim 13, wherein the mandrel has an internal thread and at least one expansion element overlaying the mandrel, wherein the at least one expansion element is displaced radially outwardly on a predetermined relative movement between the mandrel and the at least one expansion element, wherein said connector incorporates part of a relative rotation stop.

17. An anchoring device according to claim 16, wherein said part of said relative rotation stop comprises a projection provided on the connector.

18. An anchoring device according to claim 13, wherein the anchoring device is adapted to be connected to a self drilling rock bolt.

* * * * *